United States Patent [19]

Mollura

[11] 3,999,235

[45] Dec. 28, 1976

[54] PRESSURE EQUALIZER FOR WATERBED

[76] Inventor: Carlos A. Mollura, 2824 Del Oro Place, Fullerton, Calif. 917333

[22] Filed: Aug. 28, 1975

[21] Appl. No.: 608,409

[52] U.S. Cl. ..... 5/370

[51] Int. Cl.[2] ..... A47C 27/08

[58] Field of Search .... 5/348 R, 348 WB, 365–370, 5/371

[56] References Cited

UNITED STATES PATENTS

| | | | |
|---|---|---|---|
| 3,585,661 | 6/1971 | Gottfried et al. | 5/348 WB |
| 3,867,731 | 2/1975 | Isaac | 5/348 WB |

*Primary Examiner*—Paul R. Gilliam
*Assistant Examiner*—Andrew M. Calvert
*Attorney, Agent, or Firm*—Flam & Flam

[57] ABSTRACT

The waterbed comprises a body supporting liquid filled bag or bladder and a freely expansible ballast chamber in unrestricted fluid communication with the body supporting bag or bladder. The fluid interchange operates to regulate and maintain at a comfortable low value, the surface stress of the bag or bladder.

2 Claims, 3 Drawing Figures

PRESSURE EQUALIZER FOR WATERBED

BACKGROUND OF THE INVENTION

This invention relates to waterbeds of the type disclosed in U.S. Pat. No. 3,585,356 issued June 15, 1971 to Charles P. Hall and entitled LIQUID SUPPORT FOR HUMAN BODIES.

Ideally the user is supported in a comfortable position by a waterbed in such manner that the contact pressure is equalized and small. In order to minimize the contact pressure the area of contact is maximized. The ultimate limit is floatation independently of any stress in the bag itself. This theoretical limit is, in reality, not truly desirable. Thus true floatation would mean an inclined or other non-horizontal sleeping position due to the increased buoyancy of the chest cavity as compared with the lower limbs. True floatation would mean the body would tend to shift in the horizontal plane. To achieve a substantial degree of floatation, the water bag is peripherally confined so that much of the tension of the bag is relieved.

In practice, the bag tension is minimal when the bed is unoccupied. When one person rests upon the bag, the stress of body weight causes a slight tension in the bag which is unobjectionable, and perhaps desirable. But when a second person occupies the bed, the tension builds up to a point where floatation is largely lost, and bag tension serves as the primary support mechanism.

The primary object of the present invention is to provide a waterbed that automatically maintains floatation as the primary support mechanism notwithstanding substantial differences in the weight load imposed upon the waterbed.

SUMMARY OF THE INVENTION

In order to accomplish the foregoing object, I provide a freely expansible ballast chamber in unrestricted fluid communication with the body supporting bag. As increased weight is imposed upon the body supporting bag, fluid is forced into the ballast chamber. The imposition of undue stress upon the body supporting bag itself is avoided.

A further distinct object of the present invention is to provide a simple package for the ballast chamber. For this purpose, use is made of the headboard of the waterbed.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Figure 1:
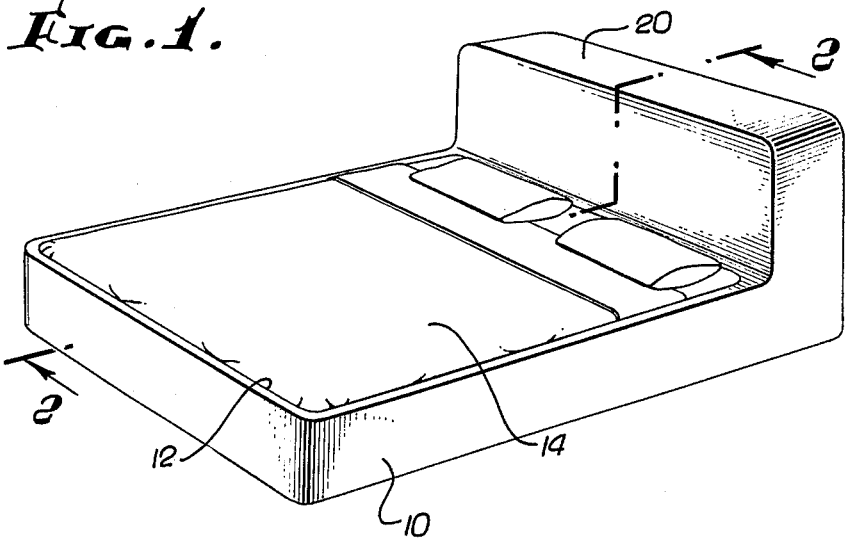
FIG. 1 is a perspective view of a waterbed incorporating the present invention.
Figure 2:
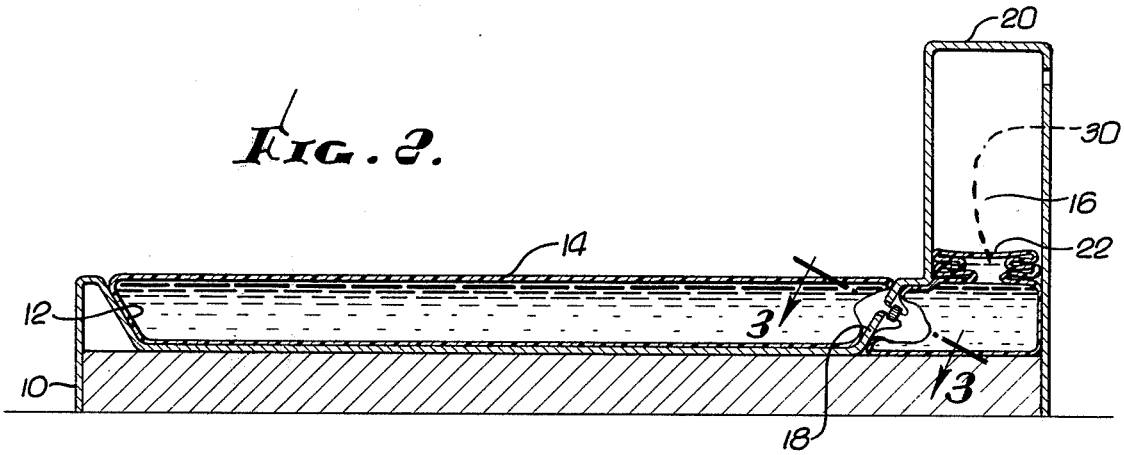
FIG. 2 is an enlarged longitudinal sectional view of the bed and taken along a plane corresponding to line 2—2 of FIG. 1.

Illustrated in FIG. 1 is a waterbed comprising a suitable shell or frame 10 made, in the present instance, of molded plastic material. The frame or shell 10 provides a recess 12 for a water bag or bladder 14. In a well known manner, the frame 10 provides relatively rigid peripheral support for the bag such that, when the bag is properly filled, the weight of the bag is supported by the peripheral and bottom walls independently of any stress in the top layer of the bag.

If desired or required, a waterproof liner may be provided for the recess.

When a person places his weight upon the water bag, the bag tends to balloon and to stress top layer. The more weight, the more stress. In order to eliminate or largely reduce the increase in stress, a ballast chamber is provided that is in free fluid communication with the waterbed bag or bladder 14. Since it is in free fluid communication, the level of fluid in the chamber and the bag will be precisely equal if the top layer of the bag has no stress and the top of the ballast chamber is likewise unconfined and equally open to atmosphere.

Figure 3:
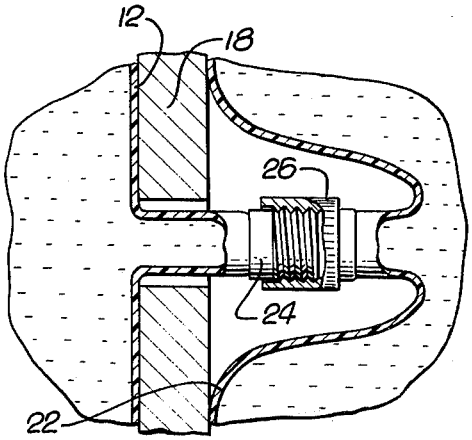
FIG. 3 is an enlarged detail sectional view of the transfer fitting, and taken along a plane corresponding to line 3—3 of FIG. 2.

The ballast chamber is conveniently provided by the waterbed frame as indicated by reference character 16. The chamber 16 is conveniently located behind the head wall 18 of the bed recess to include some or all of the hollow space inside the headboard 20. Optionally the headboard can be separate from the waterbed frame. The frame 10 gives peripheral definition to the ballast chamber 16. In order best to seal the chamber, use is made of a ballast bag 22 that fills the bottom of the ballast chamber 16. The ballast bag 22 communicates with waterbed bladder in any suitable manner. One method is illustrated in FIG. 3. The ballast bag and the waterbed bag have companion detachable coupling elements 24 and 26 that cooperate through a hole in the headboard wall 18. Optionally, the bags could be provided with conduit extensions accessible at the rear of the headboard for detachable connection and/or filling.

With the ballast bag in free communication with the waterbed bladder 14, fluid transfers to the ballast chamber when a person places his weight upon the bladder. The level freely rises in the chamber 22 as indicated by dotted line 30 since the ballast bag 22 is highly flexible and expansible. For this purpose, the top layer of the ballast bag 22 has accordion folded side walls or the like. The ballast chamber is, of course, vented at the top.

By virtue of the ballast chamber, very little stress is added to the top layer of the waterbed bag. Support primarily by floatation is ensured even when a second person places his weight upon the waterbed bladder.

The ballast chamber preferably has a large upper surface area whereby the displacement results in very little increased height and consequently very little increased stress on the waterbed top layer.

By adjusting the initial fill of the bags, a slight tension may be imposed upon the top layer of the bladder, in which case the level of the ballast chamber will, in the unloaded condition, be slightly higher than the level of the waterbed bladder. Fillers for the bags are not shown.

Intending to claim all novel, useful and unobvious features shown or described, I make the following claims:

1. In a waterbed:

a. a waterbed frame forming a recess for a body of fluid;

b. a freely flexible bladder in the recess and adapted to contain said body of fluid;

c. said frame having substantially rigid wall means to girdle said flexible bladder whereby its top portion may be substantially free of stress;

d. means forming a separate ballast chamber located beyond said wall means;

e. a bag accommodated in and sealing said ballast chamber, said bag being highly flexible and vertically expansible; and f. fluid coupling means placing said ballast chamber and said bladder in free fluid communication such that weight load upon said bladder causes displacement of fluid into said ballast chamber with consequent rise of the level therein whereby the increased stress of said bladder, if any, is minimized.

2. The combination as set forth in claim 1 in which said flexible bladder is substantially free of vertical restraint whereby no significant head of liquid may be carried by said ballast chamber in the absence of a weight load upon said bladder.

* * * * *